US005160288A

United States Patent [19]

Seda

[11] Patent Number: 5,160,288

[45] Date of Patent: Nov. 3, 1992

[54] CONVERTIBLE TOY TABLE

[75] Inventor: Milan J. Seda, Laguna Niguel, Calif.

[73] Assignee: Mattel, Inc., El Segundo, Calif.

[21] Appl. No.: 832,265

[22] Filed: Feb. 7, 1992

[51] Int. Cl.[5] ..... A63H 3/52

[52] U.S. Cl. ..... 446/482; 446/236; 108/13; 108/62

[58] Field of Search ..... 446/479, 480, 481, 482, 446/219, 236; 273/309; 108/13, 62

[56] References Cited

U.S. PATENT DOCUMENTS 155,706 10/1874 Cahill ..... 108/62 X
1,353,728 9/1920 Dence ..... 273/309 X
5,041,048 8/1991 Lehmann et al. ..... 446/236

*Primary Examiner*—Mickey Yu

[57] ABSTRACT

A toy table including a table top, a central portion of the table top being separately mounted from the remainder of the table top, apparatus for mounting the central portion of the table top to rotate and provide a first surface to the top and a second surface to the bottom, each of the surfaces of the central portion mounting items to appear on the table top, apparatus for rotating the central portion to place the second surface facing upward and the first surface facing downward, and apparatus for actuating the apparatus for rotating the central portion in response to a push from one side or the other below the table top.

4 Claims, 6 Drawing Sheets

CONVERTIBLE TOY TABLE

BACKGROUND OF THE INVENTION

1. Field Of The Invention

This invention relates to toys, more particularly, to a toy table having apparatus adapted to offer different play situations.

2. History Of The Prior Art

It is difficult for toy designers to design toys which will appeal to children. Various methods are used to make toys more appealing. Appealing toys are often said to have play value. For example, designers create toys to represent objects having known desirable characteristics such as human babies or young animals with their especially appealing features; such toys have one form of play value. Another method used by designers to impart play value to a toy is to have the toy do something that the object the toy represents might do rather than simply sitting posed or remaining inert while a child plays with it.

Fashion dolls are a staple of the toy industry. Great play value can be imparted to fashion dolls by providing accessories which may be used by a child in playing with the doll. Such accessories may be used to create a situation in which play may take place. For example, accessories such as beach balls, swim suits, and beach umbrellas create a beach play situation. If these accessories are replaced by accessories defining another play environment, the play value of the original toy may be similarly extended. Such accessories are especially valuable where they themselves include various elements which lend play value to the toys and dolls with which they are associated.

Young girls seem to take great delight in play situations in which they may emulate their mothers or other young women. Homemaking, cooking, and dining seem to hold young girls enthralled for long periods. Consequently, accessories for fashion dolls which place the dolls in such situations tend to lend great play value to the fashion dolls.

SUMMARY OF THE INVENTION

It is, therefore, an object of the present invention to increase the play value of fashion dolls by providing a new accessory for such dolls.

It is another, more specific object, of the present invention to provide a toy table designed as an accessory for fashion dolls which itself offers substantial play value to the dolls by providing convertible menus for the dolls.

These and other objects of the present invention are realized in a toy table comprising a table top, a central portion of the table top having first and second surfaces, each of the surfaces of the central portion mounting items to appear on the table top, means for mounting the central portion of the table top to rotate in the plane of the tabletop, means for rotating the central portion to place either the first surface or the second surface facing upward, and means for actuating the means for rotating the central portion in response to a push from one side or the other below the table top.

These and other objects and features of the invention will be better understood by reference to the detailed description which follows taken together with the drawings in which like elements are referred to by like designations throughout the several views.

DETAILED DESCRIPTION OF THE INVENTION

Figure 1:
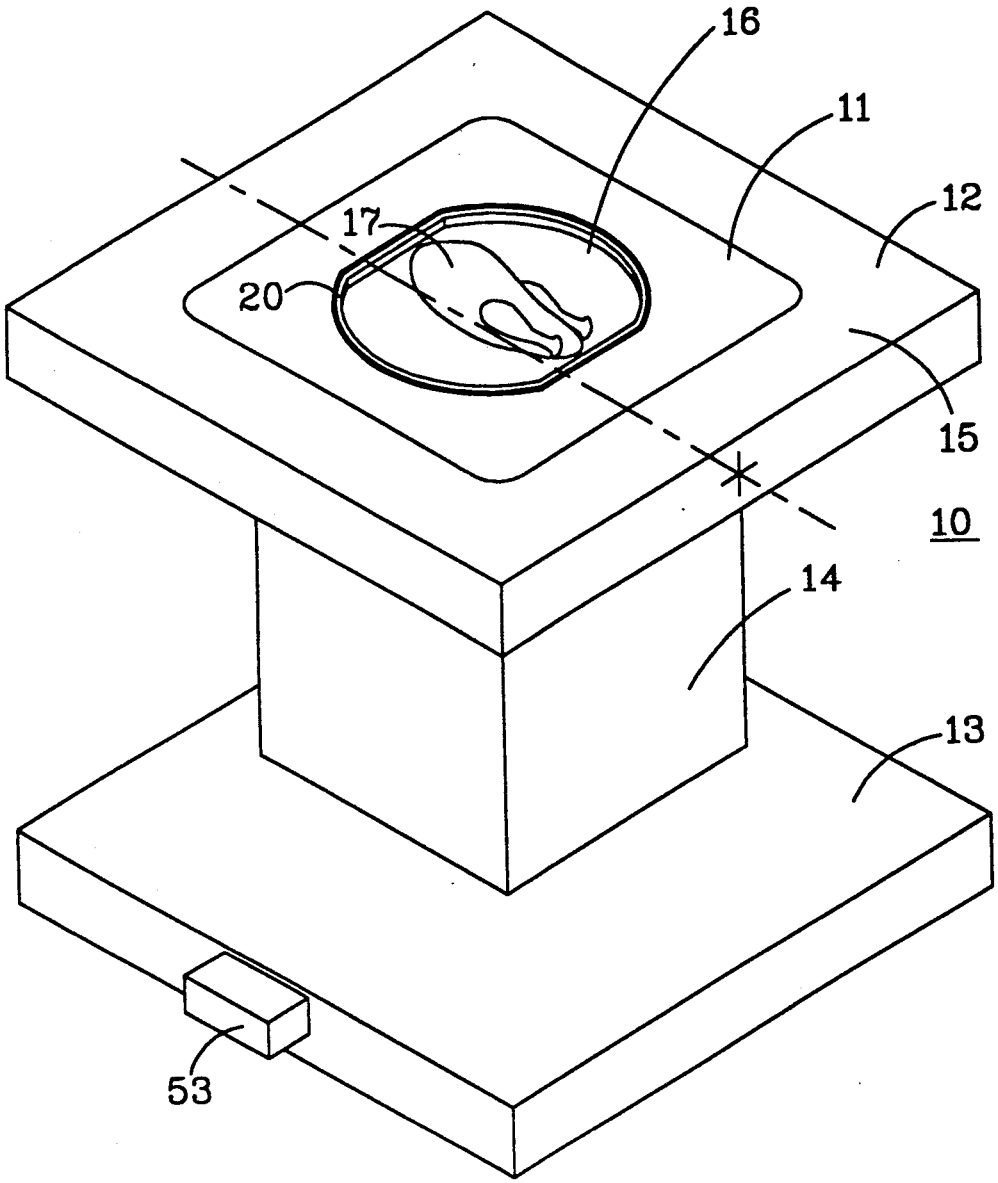
FIG. 1 is a perspective view of a table designed in accordance with the present invention.
Figure 2:
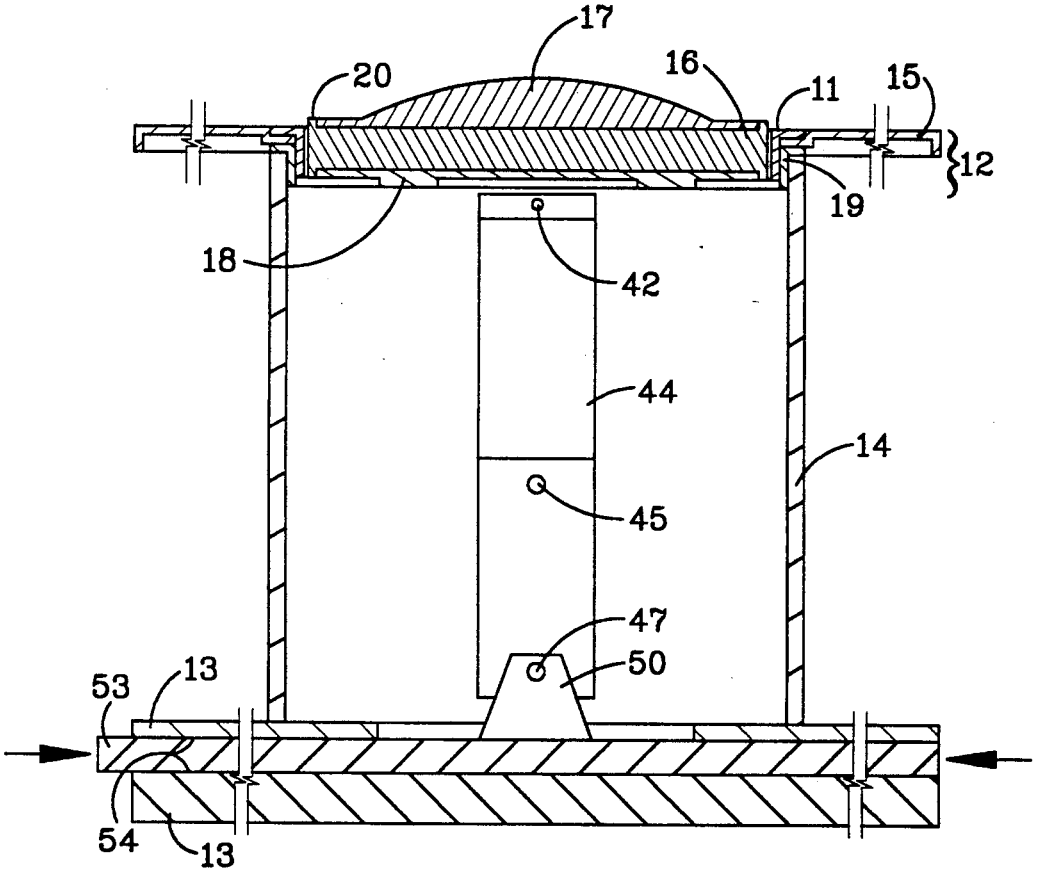
FIG. 2 is a side cross-sectional view of the table illustrated in FIG. 1.

Referring now to FIG. 1, there is illustrated a toy table 10 designed in accordance with the present invention. The table 10 is designed as an accessory to be used in establishing play situations for fashion dolls. As will be understood from the description which follows, such a table might well be used with dolls other than fashion dolls to establish similar play situations.

As may be seen in FIG. 1, the table 10 has an essentially rectangular table top 12, a rectangular base 13, and a pedestal 14 supporting the upper surface 12 above the base 13. Typically, these three major elements of the table 10 as well as the other elements of the table 10 (unless otherwise mentioned) are constructed of a moldable plastic material such as high impact styrene. The three major elements are separately molded and then snapped together by fittings well known in the art which are not a part of the present invention and are therefore not shown in the drawings.

Figure 4:
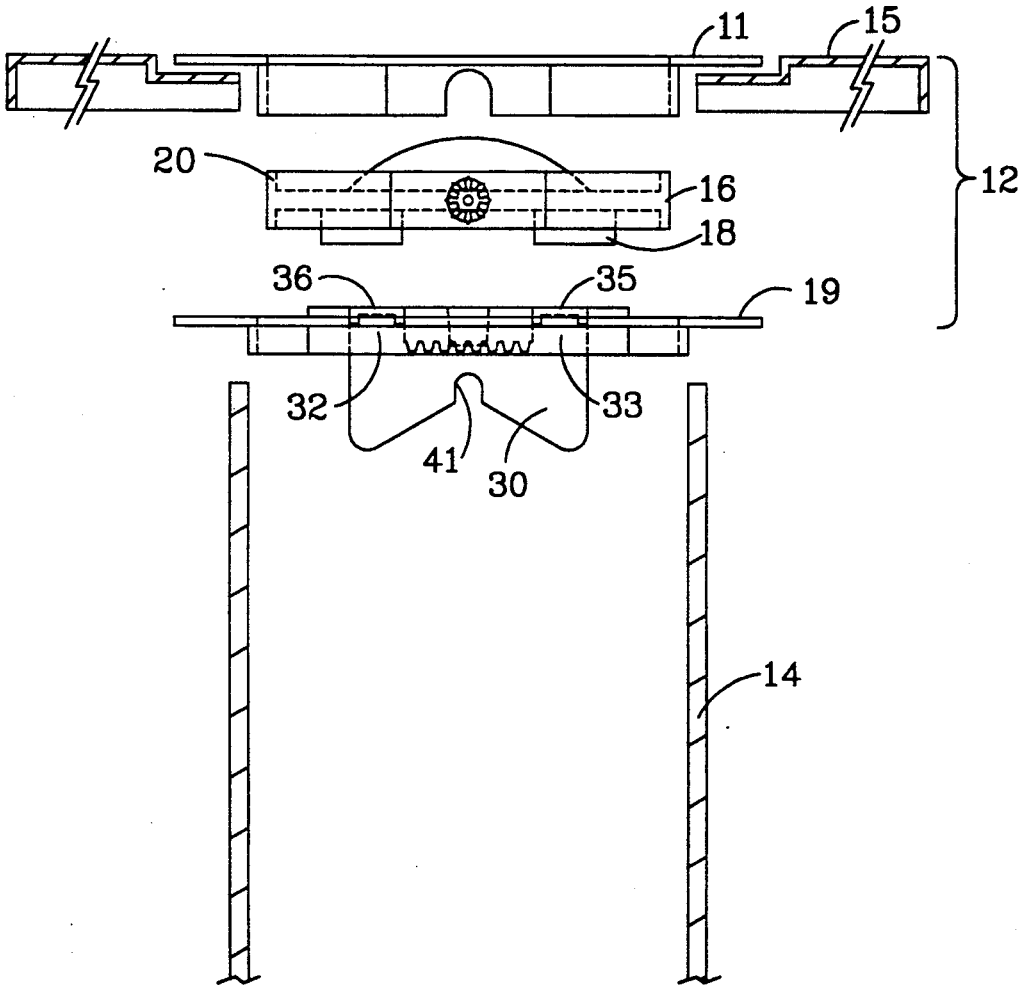
FIG. 4 is an exploded side view of an upper portion of the table of FIG. 1.

As may be seen in the exploded side view of FIG. 4, the table top 12 is constructed of four individual portions. A first portion 15 forms the outer main portion of the table top 12 and provides most of its upper surface. A centrally-located portion 11 fits over the first portion 15 and provides a hollow central circular opening in which an element 16 resides. Below and providing upward support for the element 16 is a lower centrally-located portion 19 which has a similar hollow circular opening. The portion 11 forces the first portion 15 downward against the upper edge of the lower portion 19. The portions 11 and 19 hold the element 16 in place. The lower portion 19 fits into an opening in the top of the pedestal 12.

In the center of the table top 12 in the circular opening in the portion 11 is shown the generally-flat disk-shaped element 16. Centered on the upper face of the element 16 is an object 17. In the preferred embodiment of the invention, the object 17 emulates a cooked turkey; the object 12 may be molded separately and fixed to the upper side of the element 16. Another object (or group of objects) 18 is molded into the lower surface of the element 16. This second object 18 emulates a number of individual desserts in the preferred embodiment of the invention. In the preferred embodiment of the invention, a ridge 20 may be molded into the upper surface of the element 16 so that the object 17 appears to rest on a platter on the top of the table 10. A similar ridge may be molded into the under side of the element 16 to hold the second object 18.

The element 16, which is generally disk-shaped, is mounted between circular recesses in the portion 11 and the lower portion 19 to pivot at its outer edges about an axis which lies just below the upper surface of the table top 12. This allows first one side of the element 16 and then the other to face upward. When the object 17 faces upward, it appears to be a dish at which the fashion dolls are dining. Alternatively, when the object 18 faces upward, it replaces the object 17 as a dish which the dolls are enjoying.

Figure 5:
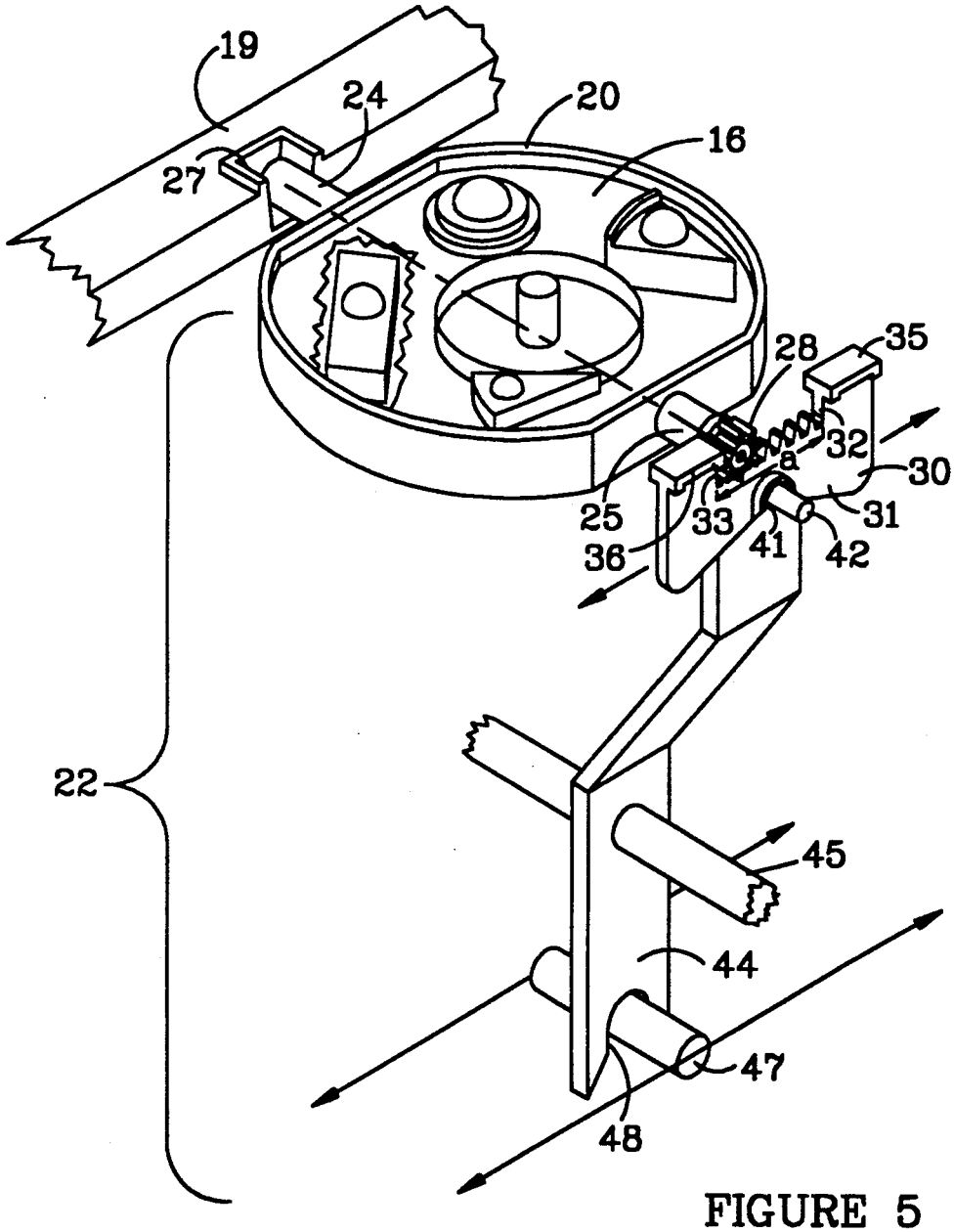
FIG. 5 is an enlarged perspective view of the details of the mechanism of the table illustrated in FIG. 1.
Figure 6:
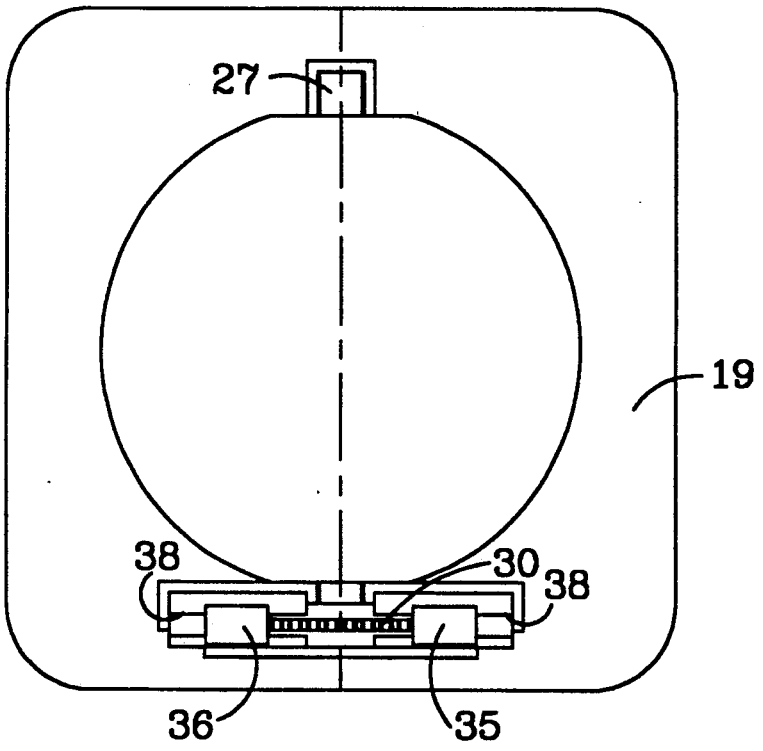
FIG. 6 is a top view of a portion of the table illustrated in the other figures.

In order to allow the two sides of the element 16 to alternately face upward, a unique mechanism is provided. The mechanism 22 is illustrated in part in each of the various FIGS. 2 through 6, but it may be best understood from the perspective view of FIG. 5 in which the mechanism 22 is illustrated apart from the remainder of the table 10. In FIG. 5, it may be seen that the element 16 is mounted to rotate along a horizontal axis which lies in the plane of the table top 12. To allow this rotation, a pair of cylindrical stub axles 24 and 25 protrude along an axis from the plane of the element 16. The axle 24 fits into a recess 27 in the upper face of the lower portion 19. The recess 27 is adapted to hold the axle 2 in place yet allow it to rotate. The axle 25 is similarly mounted in a recess in the upper face of the lower portion 19 and fixedly mounts a gear 28. The gear 28 has teeth which mesh with upwardly projecting teeth which are a part of a generally flat piece 31 of a yoke 30. The yoke 30 is mounted and held in position so that it moves in a horizontal plane as illustrated by the arrows in FIG. 5. The distance "a" illustrated in FIG. 5 and the dimensions of the gear 28, the teeth of that gear 28, and the yoke 30 are such that when the yoke 30 moves the distance "a" in a horizontal direction from one end of the row of teeth on the yoke 30 to the other end of the row of teeth, the element 16 rotates 180 degrees on its axis. If the first surface of the element 16 mounting a turkey faces upwardly when the yoke 30 is positioned so that the gear 28 touches a right upstanding element 32 of the piece 31, then as the yoke 30 moves to the right until a second upstanding element 33 of the piece 31 touches the gear 28, the element 16 will rotate on its axis to turn the second lower surface of the element 16 upward.

In order to allow the yoke 30 to move in the horizontal direction illustrated in FIG. 5, a pair of horizontal blocks 35 and 36 are molded to the upstanding elements 32 and 33 of the yoke 30, respectively. As will be seen by reference to FIG. 4, the blocks 35 and 36 slide along the upper surface of the lower portion 19 while upstanding elements 32 and 33 ride in an opening 38 in the lower portion 19. The opening 38 constrains the upstanding elements 32 and 33 to move in a straight line in the horizontal direction and limits the movement of the yoke 30 to approximately the distance "a."

The lower portion of the flat piece 31 has a recess 41 formed to accept a shaft 42 which lies in a generally horizontal plane. The shaft 42 is a part of an arm 44. The arm 44 is mounted to rotate about a solid horizontal axis parallel to the axis of the shaft 42. As may be seen, the rotation of the arm 44 about a horizontal axis (parallel to the axis of shaft 42) of a shaft 45 causes the shaft 42 to move the yoke 30 horizontally in the directions shown by the arrows in FIG. 5. The arm 44 is caused to rotate about the axis 45 by the horizontal movement of a shaft 47 in the directions illustrated by the arrows adjacent that shaft 47 in FIG. 5. The shaft 47 lies in a plane parallel to the axes of the shafts 42 and 45. The shaft 47 rides in an upward recess 48 at the lower end of the arm 44.

Figure 3:
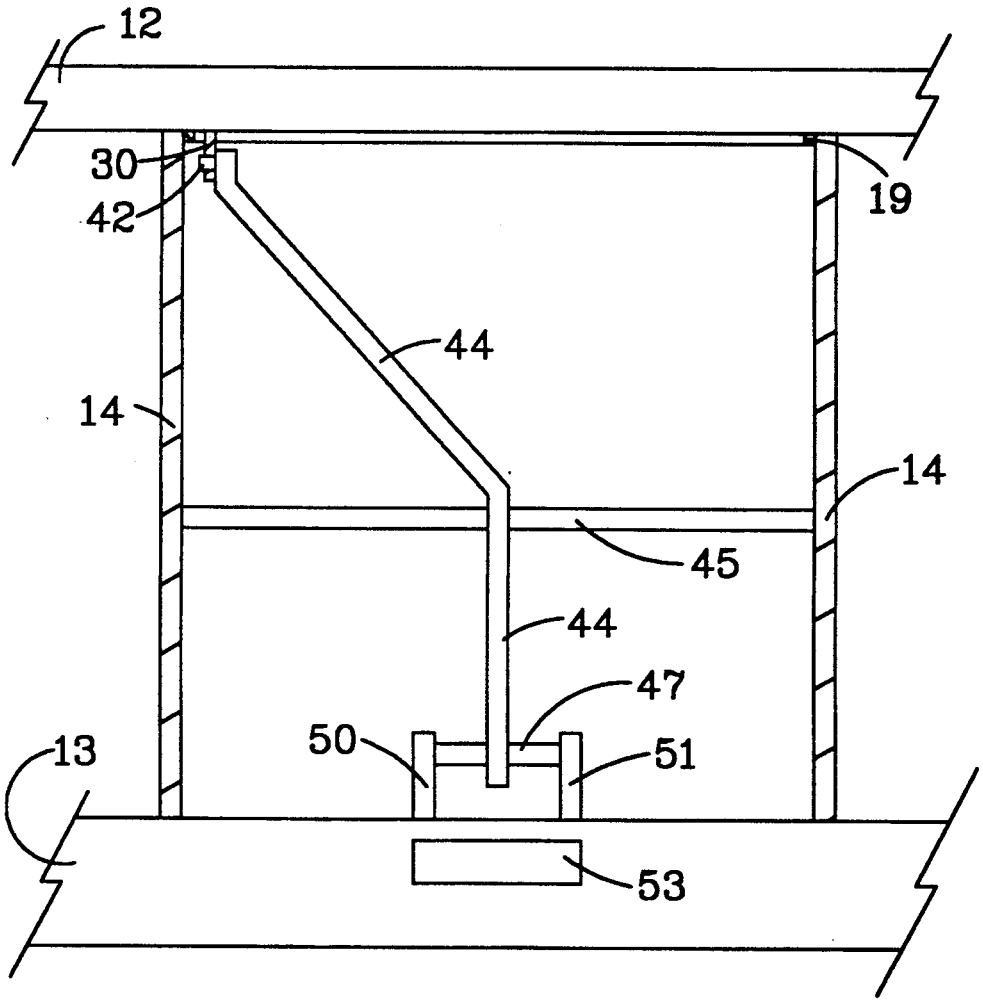
FIG. 3 is another side cross-sectional view of a pedestal portion of the table illustrated in FIG. 1.

As is shown in FIG. 3, the shaft 47 is mounted by a pair of upstanding generally-trapazoidal pieces 50 and 51 to a long flat actuating member 53. The member 53 is constrained to slide horizontally in a slot 54 in the rectangular base 13 of the table 10. The member 53 is just longer than the base 13 of the table 10 so that one end or the other of the member 53 projects from the slot 54 beyond the base 13 of the table 10. Pushing the projecting end of the member 53 toward the base 13 of the table 10 causes the member 53 to slide in the slot 54, the shaft 47 to push the arm 44 in one direction or the other, the arm 44 to rotate about the shaft 45, the shaft 42 to move the yoke 30 in a direction opposite the direction of movement of the member 53, the gear 28 to rotate, and the element 16 to rotate about its axis.

In order to lend added play value to the toy table, the member 53 is designed to be moved in the slot 54 in response to pushing a chair against its projecting end. The chair is shaped to present a flat surface which may be urged against the end of the member 53 when the chair is pushed in toward the table. In this manner, a child may push the chair under the edge of the table, and the condiment presented will change.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A toy table comprising a table top, a central portion of the table top having first and second surfaces, each of the surfaces of the central portion mounting items to appear on the table top, means for mounting the central portion of the table top to rotate in the plane of the tabletop, means for rotating the central portion to place either the first surface or the second surface facing upward, and means for actuating the means for rotating the central portion in response to a push from one side or the other below the table top.

2. A toy table as claimed in claim 1 in which the means for rotating the central portion to place either the first surface or the second surface facing upward comprises means defining an axis through the center of the central portion, a toothed gear fixed to the central portion to rotate the central portion on the axis, a yoke having teeth adapted to match the toothed gear, and means for positioning the yoke to slide in a plane parallel to the plane of the table top so that the teeth of the yoke engage the toothed gear and rotate the table as the yoke slides, and means for causing the yoke to slide in a plane parallel to the plane of the table top.

3. A toy table as claimed in claim 2 in which the means for causing the yoke to slide in a plane parallel to the plane of the table top comprises a lever arm having first and second ends and a fixed point of rotation between its ends, means for rotatably fixing one end of the lever arm to the yoke, and means for rotatably fixing the other end of the lever arm to the means for actuating the means for rotating the central portion in response to a push from one side or the other below the table top.

4. A toy table as claimed in claim 3 in which the means for rotating the central portion in response to a push from one side or the other below the table top comprises an element having first and second push points separated by a body portion, the body portion mounting the means for rotatably fixing the other end of the lever arm between the first and second ends, and means mounting the element so that the first and second push points extend from opposite sides below the table top.

* * * * *